United States Patent [19]

Marling

[11] Patent Number: 4,473,636

[45] Date of Patent: Sep. 25, 1984

[54] PROCESS AND APPARATUS FOR PHOTOGRAPHIC FILM SENSITIZATION

[76] Inventor: John B. Marling, 2111 Research Dr. #5, Livermore, Calif. 94550

[21] Appl. No.: 583,484

[22] Filed: Feb. 28, 1984

Related U.S. Application Data

[63] Continuation of Ser. No. 493,311, May 10, 1983, abandoned, which is a continuation of Ser. No. 220,682, Dec. 29, 1980, abandoned.

[51] Int. Cl.[3] ..... G03C 1/28

[52] U.S. Cl. ..... 430/501; 430/599; 354/300

[58] Field of Search ..... 430/599, 501

[56] References Cited

U.S. PATENT DOCUMENTS

| | | | |
|---|---|---|---|
| 3,542,557 | 11/1970 | Illingsworth et al. | 430/599 |
| 3,622,324 | 11/1971 | Lewis et al. | 430/599 |
| 3,891,446 | 6/1975 | Janusonis | 430/599 |
| 3,984,249 | 10/1976 | Babcock et al. | 430/543 |

OTHER PUBLICATIONS

Choong Shin-Piaw, "Influence of Pneumatic Pressure on the Photographic Sensitivity", May, 1944, pp. 285-289, Journal of the Optical Society of America, vol. 34.

R. L. Scott, A. G. Smith and R. J. Leacock, "The Use of Forming Gas in Hypersensitizing Kodak Plates", 1977, A.A.S. Photo-Bulletin, No. 15, pp. 12-15.

Alex G. Smith and Hans W. Schrader, "Balanced Hypersensitization of a Fast Reversal Color Film", 1979, A.A.S. Photo-Bulletin, No. 21, pp. 9-13.

*Primary Examiner*—Won H. Louie

*Attorney, Agent, or Firm*—Francis H. Lewis

[57] ABSTRACT

A process is disclosed for increasing the sensitivity of photographic film wound on a roll or film cartridge. The film is treated by soaking in a dilute atmosphere of hydrogen mixed with a non-reactive gas, such as nitrogen, at relatively low temperatures for long time periods. The apparatus includes a hermetically sealed chamber for the film, a pressure gauge, and valves together with a vacuum pump and gas source for administering the film treatment. An alternative version includes a heater for the chamber. The treated film exhibits enhanced sensitivity to electromagnetic radiation, reduced low-intensity reciprocity law failure, and improved accuracy of color rendition.

11 Claims, 2 Drawing Figures

PROCESS AND APPARATUS FOR PHOTOGRAPHIC FILM SENSITIZATION

This application is a continuation of application Ser. No. 06/493,311, filed May 10, 1983 abandoned, which is a continuation of application Ser. No. 06/220,682, filed Dec. 29, 1980, abandoned.

BACKGROUND OF THE INVENTION

This invention relates to photography. More particularly, the invention is directed to the hypersensitization of photographic film for purposes of increasing its sensitivity to electromagnetic radiation, and decreasing its low intensity reciprocity law failure. Photographic film treated in accordance with the invention disclosed herein is particularly suitable for photography of astronomical objects.

It is known that the speed of photographic emulsions may be increased by subjecting them prior to exposure to various gases under pneumatic pressure, including carbon dioxide, nitrogen, and hydrogen. Such a method is taught in an article in Journal of the Optical Society of America, Volume 34, pages 285–289 (1944), entitled "Influence of Pneumatic Pressure on the Photographic Sensitivity" by Choong Shin-Piaw. Other methods of increasing the sensitivity of photographic emulsions include treatment with various chemical sensitizers, and also the application of high vacuum to the emulsions prior to exposure. All of these methods result in a relatively small increase in sensitivity of the emulsions, and they do not eliminate the problem of reciprocity law failure at very low light intensities. This problem is particularly important in the photography of astronomical objects which are very distant and have extremely small luminosities.

It is also known that a substantial increase in the sensitivity of photographic emulsions can be attained by baking prior to exposure, both in vacuum and in various gaseous atmospheres. Nitrogen has been found to provide a satisfactory baking environment, particularly for astronomical applications. However, baking of emulsions produces the undesirable side effect of increased fog, which constitutes a serious limitation on the use of this method.

The treatment of photographic emulsions in an atmosphere of hydrogen has been shown to result in both a substantial increase in sensitivity and a marked reduction in low-intensity reciprocity law failure of such treated emulsions. Especially desirable results have been attained by evacuating the atmosphere surrounding the emulsions to a very high vacuum, thus removing the oxygen and moisture from the photosensitive layers, followed by soaking of the emulsions in a hydrogen atmosphere. Since pure hydrogen is very dangerous because of its propensity to form an explosive mixture with oxygen or air, it is desirable to employ only dilute mixtures of hydrogen with inert gases, such as nitrogen, in the hydrogen soaking treatment. Such mixtures, termed "forming gases", have been employed with hydrogen concentrations as low as 10 volume percent in soaking photographic emulsions at room temperature to achieve increased sensitivity. The treatment of photographic emulsions by this method does not require any substantial pressure of hydrogen or forming gas above atmospheric pressure.

Still lower concentrations of hydrogen have been used in the forming gas treatment of photographic emulsions by baking the emulsions during the treatment, or alternatively by subjecting the emulsions to a heated current of forming gas. Baking or gas temperatures in these processes range from 35° C. to about 80° C. and are preferably approximately 60° C. These methods suffer from the drawback of increased fog in the emulsions, and the resulting fog densities are greater than those encountered in the nitrogen baking method. In fact, even hydrogenation of the emulsions without baking generally produces a fog density greater than that from nitrogen baking for the same period of time. Similar results have been obtained by various sequential combinations of baking in forming gas or nitrogen and hydrogenation. In the case of colored photographic emulsions, hydrogenation has been shown to be somewhat superior to baking from the standpoint of accuracy of color rendition of the hypersensitized film.

An important limitation common to all of the methods discussed above is that they are suitable only for photographic emulsions with unobstructed surfaces to provide free access to the sensitizing gas. These processes are employed with photographic plates, or with film wound on a processing reel to maintain a gap adjacent to the emulsion surface through which the sensitizing gas can flow. If the film is wound tightly in a cartridge or roll the inner portions of the emulsion will become less sensitized than the outer portions, and unsatisfactory results will be obtained from all of the above methods. In addition, treatment of such film by any of these methods will result in an unacceptably high level of film fog.

SUMMARY OF THE PRESENT INVENTION

The present invention discloses a process for hypersensitization of photographic film wound in a roll or cartridge by soaking the cartridge in forming gas for extended periods at relatively low temperatures. The forming gas contains a mixture of nitrogen diluted with up to eight volume percent hydrogen. The film is soaked for several days in the forming gas at room temperature, approximately 20° C. Alternatively, the soaking time may be reduced by approximately one-half by raising the temperature of the gas to about 30° C. A hermetically sealed chamber for the film cartridge is provided, having means for initially removing the air and moisture from the interior, and then admitting the forming gas up to a controlled pressure. Means are provided also for heating the chamber up to a temperature of 30° C. It has been discovered by the applicant that this method yields hypersensitized photographic film with very little low-intensity reciprocity law failure, suitable for long-exposure astronomical photography. Desirable results are obtained with a wide variety of color films, as well as black and white film. The method is safe and convenient, requiring only simple and inexpensive equipment, and it is particularly suitable for amateur use.

Accordingly, it is an object of this invention to provide a method for hypersensitization of wound or cartridge-encased photographic film, without the necessity of unwinding the film or transferring it to a processing reel or other treatment device.

A second object of the invention is to provide a method for hypersensitization of photographic film without the use of gases having dangerously high concentrations of hydrogen, or any other combustively hazardous gases.

A further object of this invention is to provide a hypersensitization method yielding photographic film with substantially reduced reciprocity law failure at low light intensities.

Another object of this invention is to provide a method of film hypersensitization which yields faithful color rendition and sensitivity in a wide variety of colored photographic films, as well as black and white films.

Further objects, purposes, and advantages of the present invention will be readily apparent to persons skilled in the relevant art to which this inventions pertains upon examination of the following detailed description of the preferred embodiment, together with the accompanying drawings.

DETAILED DESCRIPTION OF THE PREFERRED EMBODIMENT

Figure 2:
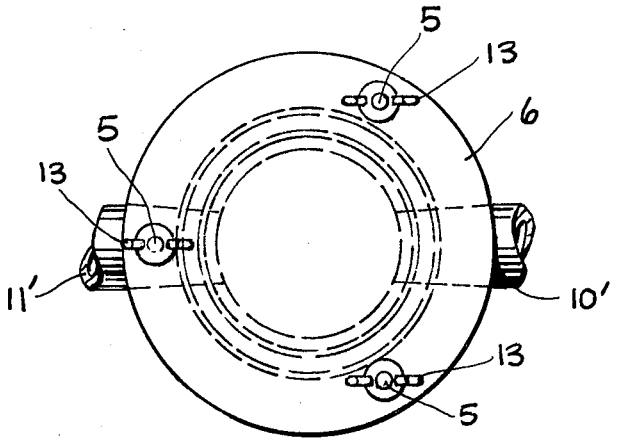
FIG. 2 is a plan view of the chamber apparatus shown in FIG. 1.
Figure 1:
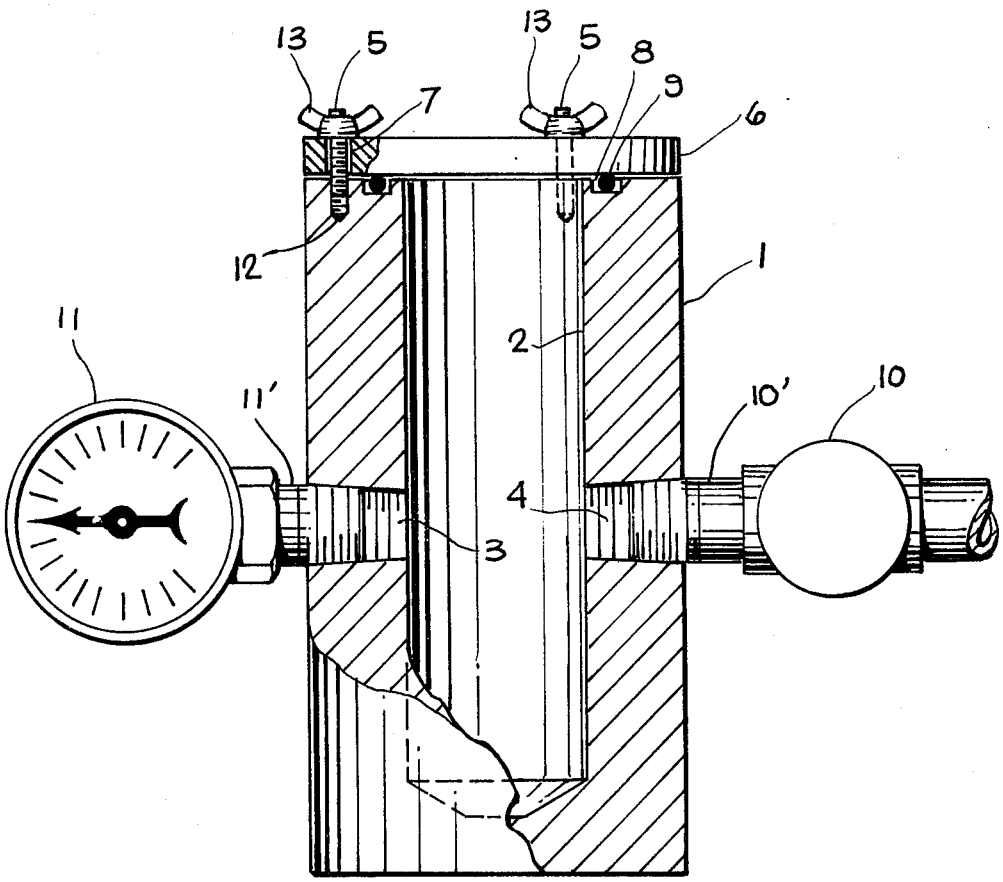
FIG. 1 is an elevational view of the chamber apparatus employed in carrying out the method of this invention, showing a cutaway section to illustrate the interior construction of the chamber.

Referring to the drawings, the apparatus used in the method disclosed herein includes a thick-walled container 1 having a cylindrical interior chamber 2 constructed to hold one or more cartridges of 35 mm. or type 120 photographic film. The chamber is open at one end and has a cover plate 6 which fits over this opening. This plate is fastened by wing nuts 13 on studs 5 extending through holes 7 in the cover plate. The studs are screwed into tapped holes 12 in the chamber wall around the opening. An O-ring 9 fits into a circular channel circumferentially disposed around the opening in the chamber wall surface facing the cover plate, and provides a hermetic seal when the cover plate is fastened in place. A pressure and vacuum gauge 11 communicates with the chamber interior through an externally threaded tapered fitting 11', which is screwed into a correspondingly tapered internally threaded hole 3 extending through the lateral wall of the chamber. A second similarly tapered threaded hole 4 perforating the lateral wall accommodates a tapered male threaded fitting 10' leading to a valve 10, which provides for controlled admission of sensitizing gas to the chamber from a pressurized source, and exhaust of gas from the chamber. The valve includes a safety pressure relief valve.

In the preferred embodiment, the outlet conduit from the valve 10 is connected to a tee fitting. One branch of the tee leads through a second valve to a pressurized tank of forming gas. The other branch of the tee connects through a third valve to a vacuum pump, which is manually operated. Thus, the entire system is portable, and requires no external source of power.

An alternative embodiment of the invention employs a heater for the chamber, consisting of a section of electrical heat tape which is wrapped around the chamber. Electrical power is supplied to the tape in an amount sufficient to heat the chamber and maintain it at a temperature of 30° C.

Another embodiment of the invention employs a power-driven vacuum pump in place of the hand-operated pump.

The apparatus described above is used to sensitize unexposed photographic film cartridges, such as 35 mm. or 120 size rolls. The cartridges are inserted into the chamber, and the cover plate is fastened in place over the O-ring by tightening the wing nuts to a tension sufficient to provide a gas-tight seal around the rim of the opening.

The initial step in the process is to open the valve 10 and pump out the air from the chamber with the vacuum pump. In the embodiment employing a manual pump, the chamber is pumped down to a vacuum in the range 24–26 inches of mercury. The vacuum pump valve is then closed and the forming gas tank valve is opened slightly. Forming gas is allowed to fill the chamber slowly until the chamber gauge shows approximately 2 psig pressure. The tank valve is then closed, the vacuum pump valve is opened, and the above cycle of evacuating the chamber and filling it with forming gas is repeated. On the third evacuation/fill cycle the chamber is filled to 15 psig pressure and the chamber valve 10 and tank valve are closed. At this point the oxygen and moisture concentrations are reduced to 0.1 percent of their atmospheric values inside the chamber. This reduction is necessary because these two constituents both act to desensitize photographic film.

In the alternative embodiment employing a power-driven vacuum pump, the chamber is pumped down to an absolute pressure of 10–100 microns of mercury, and then filled with forming gas to 15 psig pressure. Because of the greater capacity of the power-driven pump, the evacuation/fill cycle need be carried out only once to reduce the oxygen and moisture concentrations to sufficiently low values inside the chamber.

The second step in the process is to allow the film to soak in the forming gas for the appropriate time period. This period depends on the film type, forming gas composition, pressure and temperature. The optimal soaking time, resulting in the maximum film hypersensitization, is determined by the onset of chemical film fogging, which should not exceed a fog level of ND=0.3. In the preferred embodiment, the forming gas composition is 8 percent hydrogen and 92 percent nitrogen by volume, and the temperature is 20° C. (room temperature). In the alternative embodiment employing a heater for the chamber, the temperature may be increased up to 30° C. The use of temperatures in excess of 30° C. results in undesirable thermal fogging of the film. Similarly, the use of forming gas with hydrogen concentrations in excess of 8 percent causes excess fogging at soaking times necessary for treatment of film cartridges or rolls, in addition to the flammability hazard. The soaking time necessary is approximately proportional to the absolute pressure of the forming gas. The recommended forming gas pressure is 15 psig, although the process may be successfully carried out at any positive pressure of the forming gas. The following table discloses the optimal soaking times for various types of photographic film soaked in 8 percent forming gas at 15 psig pressure.

OPTIMAL SOAKING TIME FOR FILM HYPERSENSITIZATION IN FORMING GAS (8% HYDROGEN, 92% NITROGEN) AT 15 PSIG AND RESULTING SPEED GAIN

| FILM TYPE | TEMPERATURE (deg. C.) 20 | TEMPERATURE (deg. C.) 30 | SPEED GAIN RED | SPEED GAIN BLUE | RELATIVE SPEED RED | RELATIVE SPEED BLUE |
|---|---|---|---|---|---|---|
| Black and White | | | | | | |
| 2415 (SO-115) | 2–3 wks. | 7–10 days | 15X to | 30X | 1 | 1 |
| High Contrast Copy | 2–3 wks. | 7–10 days | 40X to | 80X | 0.2 | 0.3 |
| H & W VTE | 1 week | 3–4 days | 8X to | 8X | 0.12 | 0.25 |
| Kodak Tri-X | 10 days | 4–6 days | 5X to | 10X | 1 | |
| Agfapan 400 | 7–10 days | 4–5 days | 8X to | 12X | 1 | 2 |
| Ilford HP-5 | 1 week | 3–4 days | 10X to | 15X | 1.5 | 2 |
| 103a-E | 2–4 days | Not | 2X to | 3X | 1 | 1 |
| 103a-O | 2–4 days | advised | 1X to | 2X | 0 | 3 |
| 103a-F | 2–4 days | at 30° C.* | 2X to | 3X | 2 | 3 |
| Color Negative | | | | | | |
| Kodacolor 400 | 5–6 days | 2–3 days | 7X | 12X | 1 | 2–3 |
| Kodacolor II | 1 week | 3–5 days | 7X | | 0.3 | |
| Fujicolor II | 10 days | 4–5 days | 6X | 25X | 0.13 | 0.7 |
| Fujicolor 400 | 5–6 days | 2–3 days | 4–6X | | 0.2 | |
| Veracolor II | 10 days | 4–5 days | 8X | 10X | 0.25 | 1 |
| Color Reversal (Slide) | | | | | | |
| Ektachrome 400 | 5–6 days | 2–3 days | 7X | 12X | 1 | 2–3 |
| Ektachrome 200 | 1 week | 3–5 days | 2–3X | 8X | 0.7 | 1 |
| Ektachrome 64 | 1 week | 3–4 days | 4X | 8X | 0.15 | 0.25 |
| Fujichrome RD100 | 5–6 days | 2–3 days | 4X | 10X | 0.7 | 1 |
| Fujichrome 400 | 5–6 days | 2–3 days | 2X | 6X | 0.7 | 0.6 |

*Some test results show excess thermal fogging. However, see Example 1, infra.

At the end of the soaking period, the forming gas is released from the chamber and the film is removed. In may be used immediately. Treated film may be stored at room temperature for up to several days before exposure, or several months in a refrigerator freezer, without significant loss of sensitivity.

The speed gains indicated in the preceding table refer to photography at long exposures of faint extended astronomical objects, such as galaxies or emission nebulae. The speed gains for photography of bright objects such as planets or stars are substantially lower. This relative increase in film speed for low intensity exposures compensates partially for the decrease in unsensitized film speed at low light intensities, or low-intensity reciprocity law failure, common to most photographic emulsions. Thus, films treated by the method of the present invention exhibit a substantial reduction in low-intensity reciprocity law failure.

It will be further noted from the table that in all cases the speed gain from this treatment method is greater for blue light than for red light, except for black and white film showing equal gain. This difference in speed gain compensates partially for the normal excess red sensitivity of most untreated films at long low-intensity exposures. Therefore, films treated by the method of this invention exhibit improved accuracy of rendition of colored objects.

The method disclosed herein differs from previous methods of film sensitization with forming gas in the use of lower temperatures and substantially longer treatment times. These differences allow this method to be used on film cartridges and rolls with excellent results, whereas previous methods have produced unsatisfactory results in such cases. Some examples of test comparing the present method with previous sensitization methods on film cartridges and rolls are given below.

EXAMPLE 1

Kodak Type 103a-O Film

An article by R. L. Scott, A. G. Smith, and R. J. Leacock, "The Use of Forming Gas in Hypersensitizing Kodak Spectroscopic Plates", published in the A.A.S. Photo-Bulletin, No. 15, pages 12–15 (1977), teaches a method for sensitizing type 103a-O emulsion on plates by soaking the plates in forming gas containing eight volume percent hydrogen for four hours at 72.5° C.

Type 103a-O film, rolled up in a cassette, was soaked in forming gas with 8 percent hydrogen at 70° C. for four hours, according to the above method. The resulting film was totally ruined with a fog level ND=4.

A second roll of type 103a-O film, rolled up in a cassette, was soaked in forming gas with 8 percent hydrogen and 15 psig pressure at 30° C. for 2 days, according to the present invention. The resulting film exhibited a 100 percent increase in film speed and a small fog level of ND=0.3.

EXAMPLE 2

Kodak Ektachrome 400 Film

An article by Alex G. Smith and Hans W. Schrader, "Balanced Hypersensitization of a Fast Reversal Color Film", published by the A.A.S. Photo-Bulletin, No. 21, pages 9–13 (1979), teaches a method for sensitizing Ektachrome 400 film unrolled and loaded onto a processing reel by soaking the reel in forming gas containing 8 percent hydrogen for four hours at 65° C.

A cassette roll of Ektachrome 400 film was soaked in forming gas with 8 percent hydrogen for four hours at 65° C., according to the above method. The resulting film was heavily fogged and unusable.

A second cassette roll of Ektachrome 400 film was soaked in forming gas containing 8 percent hydrogen at 15 psig pressure and 30° C. for 2.5 days, according to the present invention. The resulting film exhibited a speed gain of 5–15X and fog levels less than ND=0.3.

It will be further appreciated that the method and apparatus disclosed herein are simple, inexpensive, safe, and easy to use. The invention is particularly suitable for use by amateur astronomers and photographers. Since the film is treated in its original cartridge or roll, no darkroom equipment is necessary. The results obtained with the present invention are equal or superior in quality to those obtained with more complex, sophisticated, or hazardous methods of film hypersensitization, such as those previously known prior to this invention.

I claim:

1. A process for increasing the sensitivity of photographic silver halide film, comprising:

substantially reducing the concentrations of atmospheric gases and moisture in said film; and treating said film with a gaseous atmosphere containing not more than 8 volume percent of hydrogen at a temperature not exceeding 30 degrees C. until the sensitivity of said silver halide film is increased without an increase of film fogging to unsatisfactory levels, wherein said film is further wound on a roll.

2. A process according to claim 1, wherein the temperature of said gaseous atmosphere does not exceed approximately 20 degrees C.

3. A process according to claim 1, wherein the concentration of atmospheric gases and moisture is reduced by subjecting said film to vacuum treatment.

4. A process according to claim 1, wherein the step of reducing the concentration of atmospheric gases and moisture comprises alternately repeating the following two steps one or more times:

the step of subjecting said film to vacuum treatment;

the step of subjecting said film to a gaseous atmosphere containing substantially no oxygen or moisture.

5. A process according to claim 1, wherein said concentration of atmospheric gases and moisture is reduced by about 99.9 percent.

6. A process according to claim 1, wherein said treatment with a gaseous atmosphere is maintained from about 2 days to about 3 weeks.

7. A process according to claim 1, wherein said gaseous atmosphere contains a mixture of hydrogen with a substantially non-reactive gas.

8. A process according to claim 7, wherein said non-reactive gas contains nitrogen.

9. A process according to claim 1, wherein said treatment with a gaseous atmosphere is maintained at a pressure above atmospheric pressure.

10. A process according to claim 1, wherein said gaseous atmosphere is maintained at a pressure about 15 psig.

11. A process according to claim 1, wherein said film roll is encased in a film cartridge.

* * * * *